US005842576A

United States Patent [19]

Snow

[11] Patent Number: 5,842,576

[45] Date of Patent: Dec. 1, 1998

[54] CARTON

[76] Inventor: David Snow, 21 Royal Close, Henbury, Bristol BS10 7XF, United Kingdom

[21] Appl. No.: 709,687

[22] Filed: Sep. 9, 1996

[30] Foreign Application Priority Data

Sep. 14, 1995 [GB] United Kingdom ..... 9518852
Feb. 22, 1996 [GB] United Kingdom ..... 9603816

[51] Int. Cl.[6] ..... B65D 5/52

[52] U.S. Cl. ..... 206/736; 229/120.011

[58] Field of Search ..... 229/101, 101.1, 229/103, 120.011; 206/736, 192

[56] References Cited

U.S. PATENT DOCUMENTS

| | | | |
|---|---|---|---|
| 2,083,868 | 6/1937 | Rottman | 229/101 |
| 2,280,793 | 4/1942 | Carruth | 229/120.011 |
| 2,672,275 | 3/1954 | Rudine | 229/120.011 |
| 3,092,301 | 6/1963 | Selle | 229/120.011 |
| 3,486,682 | 12/1969 | Mahon et al. | 229/101 |
| 3,912,157 | 10/1975 | Graser | 229/120.011 |
| 4,235,364 | 11/1980 | Baker | 229/101.1 |
| 4,452,367 | 6/1984 | Wein | 229/101.1 |
| 5,180,056 | 1/1993 | Adams et al. | 229/120.011 |

FOREIGN PATENT DOCUMENTS

| | | | |
|---|---|---|---|
| 637327 | 2/1962 | Canada | 229/120.011 |
| 2 713 597 | 6/1995 | France . | |
| 2 027 413 | 2/1980 | United Kingdom . | |

*Primary Examiner*—David T. Fidei
*Attorney, Agent, or Firm*—Reed Smith Shaw & McClay LLP

[57] ABSTRACT

A carton for use as a transit pack, and which is convertible to a display tray, is formed from a single blank of material. The carton includes a lower section from which the display tray is formed and an upper section which mates with the lower section to form a transit pack of substantially conventional outward appearance. The upper and lower sections of the carton at least partially overlap each other, and at least one connection tab operates to join the upper and lower sections together. The connection tab includes a line of weakness which can be broken to separate the upper and lower sections, whereby the carton may be converted to a display tray by removing the upper section.

9 Claims, 11 Drawing Sheets

CARTON

BACKGROUND OF THE INVENTION

This invention relates to cartons and blanks therefore, particularly of corrugated board, which allow for transportation and display of goods contained therein.

Cartons have long been used for the transportation of goods and increasingly such goods are not just being transported in those cartons but remain therein for display purposes. There is a need for cartons which may be easily opened so as to leave a clean-cut, non-damaged part of the container which can be used to display goods contained within the carton without detracting therefrom. The speed at which such cartons may be opened is considered paramount, with supermarkets, in particular, striving to reduce the time in which transit cartons can be opened and the goods therein displayed.

Many attempts have been made to design cartons which are easily opened to provide a display tray in which goods contained in the carton can be displayed.

Such cartons involve the use of opening mechanisms such as perforations, tear tapes and lines of weaknesses to facilitate the initial opening of the carton. Known cartons suffer from a variety of disadvantages such as difficulty in manufacture due to aligning tear tapes and line of weaknesses, untidy openings which are not clean and do not leave an undamaged open surface and weakness of the unopened carton causing problems in filling or transportation.

One previously proposed solution is a transit pack instantly convertible to a display tray, which pack is formed from a lower part which forms the display tray and a separate covering hood which fits inside the display tray. Parts of the overlapping surfaces are provided with adhesive to stick the display tray and hood together. The display tray is provided with areas delimited by perforations which correspond with the position of the adhesive. The goods are transported in the assembled tray and hood which substantially resembles a normal transportation carton. Upon arrival at the display point the perforations surrounding the adhered portions are broken to allow the hood to be lifted free of the display tray. The upper edges of the display tray are precut by machine to provide clean cut edges so that when the hood is lifted free a neat display tray is left. Although this design has been commercially successful, provides a display tray with a neat clean cut edge and can be opened in a matter of seconds it does have disadvantages, particularly in its manufacture. During its manufacture it is necessary to accurately align the two separate blanks, i.e. the blank for the lower display case and that for the upper hood. The alignment is difficult and time consuming to achieve leading to expensive manufacture, particularly as the number of cartons which are not accurately aligned and which have to be disposed of is relatively high. Furthermore, requiring separate blanks for the display tray and the covering hood leads to inefficient use of the material from which they are formed, again increasing the cost of the design.

From FR-A-2713597 there is known another transit carton convertible to a display tray. The carton is formed from a single blank which has a first surface and a second surface each of which is composed of four panels corresponding to the four sides of the erected carton. The first surface of the blank corresponds to, i.e. can be assembled into, the lid of the carton and the second surface corresponds to the bottom of the carton which forms a display tray when the lid is removed. The first and second surfaces are connected to each other by two foldable and tearable lugs which are formed in two parts and have two parallel fold lines. In the assembled carton, by folding around the fold lines of the lugs, the lid formed from the first surface is nested within the bottom part. The sides of the lid, which have a straight common lower edge, extend to the floor of the carton, with the lower edge sitting on the carton bottom, and the lid is maintained in its nested place by tight packing of goods within the assembled carton. The carton is converted by tearing off the lugs from the bottom part which allows the lid to be separated therefrom leaving a display tray holding the goods previously tightly packed into the carton. This design, although overcoming the problem of aligning two separate blanks, has many disadvantages. Firstly, the design is not provided with means of fixing the lid nested within the bottom. The assemblage only retains its appearance as a conventional transit carton due to the tight packing of goods inside the carton which push the nested parts of the lid against the outer bottom holding it in place. The overall structure is, therefore, very weak. The packed carton would fall apart if handled or carried by its lid alone and without tightly packed goods or when the carton is empty the lid and the bottom would be moveable relative to each other giving an unstable, wobbly structure. Secondly, the need for the sides of the lid to extend to the floor of the carton requires an uneconomic use of material. Not only because the sides of the lid have to be of the full depth of the carton but also because large lugs are required. This is because the lower fold line of the lug is in line with the lower edge of the lid so that the height (h) of the lug (i.e. the distance between its fold lines) must be half the height (H) of the sides of the display tray to which the lugs are connected. If sides of the display tray having the full depth of the carton are required lugs of half that full depth are required. Large amounts of overlapping material is required for the prior art design which leads to substantial wastage of material and thereby increased expense of manufacture. Thirdly, if variation in the shape or height of the sides of the display tray is required it is necessary to form a suitably shaped cut out in the blank requiring further wastage of material. A further disadvantage of the prior art design is that the large amount of overlapping material is bulky. To alleviate that problem in the corners of the assembled carton slots are provided. The presence of these slots weakens the strength of the carton considerable as the strength of a carton depends on the strength of its corners. A yet further disadvantage of the prior art design is that it has overlapping glue laps. Glue laps are narrow flaps provided on a free side edge of a carton blank to allow fixing of the two free side panels of the blank. The gluing down of glue laps is usually carried out during manufacture of a carton blank and preferably carried out by machine. In the prior art design both the inner lid and the outer bottom is provided with a glue lap. These glue laps have to be overlapped in the assembled carton. It would not, however, be possible for both glue laps to be glued into place by machine. The prior art design, therefore, poses manufacturing problems.

There is therefore a need for a carton, which can function as a transit pack but which is instantly convertible to a neat display tray, which overcomes or mitigates some or all of the problems associated with the known prior art.

SUMMARY OF THE INVENTION

According to a first aspect of the present invention, there is provided a carton for use as a transit pack and convertible to a display tray whose top edges are pre-cut or pre-folded, which carton is formed from a single blank of material and comprises a lower part from which the display tray is formed and an upper part which mates with the lower part to form a transit pack of substantially conventional outward appearance, the upper and lower parts being provided with an area in which the upper and lower parts overlap each other, which carton is provided with at least one connection tab which joins the upper and lower sections together, which connection tab has associated with it a line of weakness which can be broken to separate the upper and lower sections joined by its connection tab and the carton can be converted to a display tray by removal of the upper section, wherein the upper and lower sections are secured to each other in the area of overlap.

According to a second aspect of the present invention there is provided a carton for use as a transit pack and convertible to a display tray whose top edges are pre-cut or pre-folded, which carton is formed from a single blank of material and comprises a lower section from which the display tray is formed and an upper part which mates with the lower part to form a transit pack of substantially conventional outward appearance, the upper and lower parts being provided with an area in which they overlap each other, which carton is provided with at least one connection tab which joins the upper and lower sections together, which connection tab has associated with it a line of weakness which can be broken to separate the upper and lower sections joined by its connection tab and the carton can be converted to a display tray by removal of the upper section, wherein at least one side of the lower part extends the full depth of the carton.

In such a case it is not necessary for the upper part to have a side corresponding to the full depth side of the lower part. That side of the carton need not have any overlapping area. The upper part can have, therefore, one side less than the lower part. Preferably at least one side of the upper part of the carton according to the second aspect of the invention extends the full depth of the carton.

According to a third aspect of the present invention there is provided a carton for use as a transit pack and convertible to a display tray whose top edges are pre-cut or pre-folded, which carton is formed from a single blank of material and comprises a lower section from which the display tray is formed and an upper part which mates with the lower part to form a transit pack of substantially conventional outward appearance, the upper and lower parts being provided with an area in which they overlap each other, which carton is provided with at least one connection tab, which joins the upper and lower sections together, which connection tab has associated with it a line of weakness which can be broken to separate the upper and lower sections joined by its connection tab and the carton can be converted to a display tray by removal of the upper section, wherein at least one side of the upper part terminates before the bottom of the carton.

The at least one side does not extend to the bottom of the carton and the overlap of the upper and lower parts on that side is smaller in height than the height of the corresponding side of the lower part.

According to a fourth aspect of the present invention there is provided a carton for use as a transit pack and convertible to a display tray whose top edges are pre-cut or pre-folded, which carton is formed from a single blank of material and comprises a lower section from which the display tray is formed and an upper part which mates with the lower part to form a transit pack of substantially conventional outward appearance, the upper and lower parts being provided with an area in which they overlap each other, which carton is provided with a connection tab which joins the upper and lower sections together, which connection tab has associated with it a line of weakness which can be broken to separate the upper and lower sections joined by its connection tab and the carton can be converted to a display tray by removal of the upper section, wherein a lap to secure the sides of the carton is provided on the lower part only.

Preferably a carton according to the second, third or fourth aspects of the invention is also such that the upper and lower parts are secured to each other in the area of overlap.

Preferably a carton according to the first, third or fourth aspects of the invention also has at least one side of the lower part which extends the full depth of the carton.

Preferably a carton according to the first, second or fourth aspect of the invention is also such that one side of the upper part terminates before the bottom of the carton.

Preferably a carton according to the first, second or third aspects of the invention is also such that a lap to secure the sides of the carton is provided on the lower part only.

According to a fifth aspect of the present invention there is also provided a blank formed from a single piece of material, which blank is erectable into a carton for use as a transit pack and convertible to a display tray whose top edges are pre-cut or pre-folded, which blank is provided with a cut or slit which partially divides the blank into a first section and a second section, the first section being erectable into a lower part of the carton from which the display tray can be formed and the second section being erectable into an upper part of the carton capable of mating with lower part to form a transit pack of substantially conventional outward appearance, the first and second sections being joined together via a line of weakness that may be broken and which is associated with a connection tab defined by a pair of fold lines with which the blank is provided, the pair of fold lines being positioned so that when the blank is folded about one of the fold lines in one direction and about the other one of the fold lines in the other direction an area of overlap between the first and second sections is produced in which the connection tab and the first and second sections are superimposed, wherein the blank is ready for erection with the connection tab and the overlapping parts of the first and second sections being superimposed on each other and the first and second sections are secured to each other in the region of overlap.

According to a sixth aspect of the present invention there is provided a blank formed from a single piece of material, which blank is erectable into a carton for use as a transit pack and convertible to a display tray whose top edges are pre-cut or pre-folded, which blank is provided with a cut or slit which partially divides the blank into a first section and a second section, the first section being erectable into a lower part of the carton from which the display tray can be formed and the second section being erectable into an upper part of the carton capable of mating with the lower part to form a transit pack of substantially conventional outward appearance, the first and second sections being joined together via a line of weakness that may be broken and which is associated with a connection tab defined by a pair of fold lines with which the blank is provided, the pair of fold lines being positioned so that when the blank is folded about one of the fold lines in one direction and about the other one of the fold lines in the other direction an area of overlap between the first and second sections is produced in which the connection tab and the overlapping parts of the first and second sections are superimposed, wherein the first section is provided with one panel which is to form a side of the erected carton which has a length of the full depth of the carton when erected.

In this case the second section does not need to have a panel corresponding to the full depth panel of the first section. The second section can have, therefore, one less panel than the first section.

According to a seventh aspect of the present invention there is provided a blank formed from a single piece of material, which blank is erectable into a carton for use as a transit pack and convertible to a display tray whose top edges are pre-cut or pre-folded, which blank is provided with a cut or slit which partially divides the blank into a first section and a second section, the first section being erectable into a lower part of the carton from which the display tray can be formed and the second section being erectable into an upper part of the carton capable of mating with the lower part to form a transit pack of substantially conventional outward appearance, the first and second sections being joined together via a line of weakness that may be broken and which is associated with a connection tab defined by a pair of fold lines with which the blank is provided, the pair of fold lines being positioned so that when the blank is folded about one of the fold lines in one direction and about the other one of the fold lines in the other direction an area of overlap between the first and second sections is produced in which the connection tab and the overlapping parts of the first and second sections are superimposed, wherein the lower edge of at least one panel of the second section when the first and second sections are overlapped does not extend to the lower edge of the corresponding panel of the first section which it overlaps.

According to an eighth aspect of the present invention there is provided a blank formed from a single piece of material, which blank is erectable into a carton for use as a transit pack and convertible to a display tray whose top edges are pre-cut or pre-folded, which blank is provided with a cut or slit which partially divides the blank into a first section and a second section, the first section being erectable into a lower part of the carton from which the display tray can be formed and the second section being erectable into an upper part of the carton capable of mating with lower part to form a transit pack of substantially conventional outward appearance, the first and second sections being joined together via a line of weakness that may be broken and which is associated with a connection tab defined by a pair of fold lines with which the blank is provided, the pair of fold lines being positioned so that when the blank is folded about one of the fold lines in one direction and about the other one of the fold lines in the other direction an area of overlap between the first and second sections is produced in which the connection tab and the overlapping parts of the first and second sections are superimposed, wherein a lap to secure the sides of the erected carton is provided on the first section of the blank only.

Preferably a blank according to the sixth, seventh or eighth aspects of the present invention is also such that it is made ready for erection with the connection tab and the first and second sections being superimposed on each other and the first and second sections are secured to each other in the area of overlap.

Preferably a blank according to a fifth, seventh or eighth aspects of the present invention is also such that the first section is provided with one panel which is to form a side of the erected carton which has a length of the full depth of the carton when erected.

Preferably a blank according to the fifth, sixth or eighth aspects of the present invention is also such that when the first and second sections are overlapped the lower edge of at least one panel of the second section does not extend to the lower edge of the corresponding panel of the first section which it overlaps.

Preferably a blank according to the fifth, sixth or seventh aspects of the present invention is also such that a lap to secure the sides of the erected carton is provided on the first section of the blank only.

During the erection of the blank into a carton the blank is folded about the pair of fold lines so as to form an overlapping area of the first and second sections, then the blank may then be erected into a carton resembling a conventional transit pack and can be converted for display by breaking the line of weakness to separate the first and second sections. Removal of the second section leaves the first section in the form of a display tray the top edges of which are provided by the edges of the cut or slit and one of the pair of fold lines or the line of weakness.

The shape, dimensions and positioning of the connection tab and the line of weakness can be varied as desired. The smaller the connection tab the better as far as reducing bulk in the overlapping area and the overall amount of material used is concerned. It is preferred that rather than one large connection tab more than one, e.g. a plurality of, small discrete connection tabs is used. Preferably two separate connection tabs are provided and more preferably those two connection tabs are present on panels of the blank which are to be opposed to each other, e.g. to be opposing sides in the carton as erected. The connection tabs may be provided across an entire panel of the blank, but preferably for the reasons given above it extends over only a partial part of such a panel.

The line of weakness associated with the connection tab may be positioned parallel to one or both of its associated fold lines. It may also be positioned on one of the fold lines. The line of weakness may be positioned where desired, e.g. on the first or second sections or on the connection tab. Its positioning will determine whether the connection tab will remain on the display tray either fully or partially after removal of the upper part from the erected carton.

Preferably one of the pair of fold lines is provided on the first section of the blank and forms a part of the top edge of the display tray.

The line of weakness may take any suitable form, e.g. it could be a pre-perforated line or a deep fold line. Means may be provided for assisting the breakage of the line of weakness. Such means could take the form of hand holes, tear tags or tear tapes etc., which are provided either close to the line of weakness or elsewhere on the blank and carton, e.g. on the panel of the blank which is to form the front side of the erected carton.

Securing of the overlapped area can be accomplished by any suitable means such as any method conventionally used in the field, e.g. stapling. Securing is preferably effected by adhesion via the provision for example of glue. The position at which the overlapping area is secured can be varied. The overlapping region is preferably secured where the connection tab is positioned. More than one secured region may be provided, e.g. at the position of each connection tab where more than one is provided. When securing takes place where the connection tab is positioned all three layers of the overlapping region (i.e. the first section, the connection tab and the second section) do not need to be secured and it is preferred that only two of the layers are secured. The identity of the two layers which are secured will determine, along with the positioning of the line of weakness, which parts of the blank remain on the display tray after removal of the upper part of the erected carton. The overlapped first section may be secured to the connection tab but preferably the connection tab is secured to the second section. With the latter arrangement if the line of weakness is provided on the blank on or below the lower fold line of the connection tab (i.e. on the fold line or on the first section) the connection tab will be fully removed when the upper part of the carton is removed. Overlapping areas of the first and second section (i.e. the upper and lower part of the carton) other than those adjacent the region between the pair of fold lines of the connection tab may be secured. These regions may be instead of or additional to those associated with the connection tab. Any such alternative or additional secured regions should be delimited by lines of weaknesses, e.g. perforated lines, which may be broken to allow the upper and lower parts to be separated. Such an alternative or additional secured region is advantageously provided on the front side of the carton. The securing of the overlapping areas preferably takes place during manufacture of the blank so that it is in a form ready for erection.

With the present invention it is not necessary for all of the panels of the upper part of the carton to extend down to the bottom of the carton and hence for all the side panels of the second section of the blank to extend down to the lower edge of the side panels of the first section which they overlap. It is therefore not necessary for the height of the overlapping area for each side to be equal to the height of the sides of the lower part of the carton. It is not necessary for the lower edge of the first section or upper part to be a straight line as it is in the prior art design discussed above. With the present invention the area of overlap can be kept to a minimum thereby making savings on material. If desired none of the sides of the upper part extend to the carton bottom. For a rectangular carton one, two, three or all four sides of the upper part may terminate before the bottom of the carton. Preferably, however at least one side of the upper part does extend to the bottom of the carton to give added strength. As the lower edge of the upper part or second section does not need to be a straight line extending across all panels it is possible for the lower edge of the second section to correspond in shape to the upper edge of the first section. This allows both that lower edge and that upper edge to be formed from the cut or slit in the blank. The upper edge of the first section of the blank, i.e. the lower part of the carton and thereby of the display tray, can be varied in shape by simply varying the shape and positioning of that cut or slit without the need to make special cut-outs in the blank which leads to further wastage of material. The height of the walls of the display tray can, therefore, be varied without wastage of material.

The carton when erected should have the appearance of a conventional carton, e.g. to have a bottom, e.g. formed from bottom closure flaps, sides and a top, e.g. formed from top closure flaps. The upper part of the carton preferably sits inside the lower part which is to form the display tray, although it could sit outside it if required.

The blank may be provided with any arrangement of panels and flaps suitable to produce the carton and display tray required. Moreover the relative shape and size of the various blank panels (and thereby the carton sides) can be varied as required or desired. The height of the panels of the blank which are to form the sides of the carton may be varied as desired. Where one of the sides (e.g. the back) of the lower part (i.e the display tray) is to extend the full depth of the carton there is no need to have a corresponding side on the upper part of the carton, which leads to additional material savings. There is in such a case no overlapping of the upper and lower parts on that side. The second section of the blank of the carton does not need to have a side panel corresponding to that side in the upper part. One of the side panels of the blank does not, therefore, need to be divided by the cut or slit into first and second sections. This allows the blank to be formed with a second section that has one less side panel than the first section. For a four sided carton the first section can have four side panels and the second section may have three. Preferably the panels of the blank which are to form the sides (as opposed to the front or rear sides) of the display tray are angled from the front towards the rear. The degree of angle of the sides could of course be varied according to desire. To provide the erected carton with strength it is preferred that at least one side of the display tray and one side of the upper part (preferably an opposing side) extend the full depth of the carton.

The shape of the sides of the display tray can be simply varied by changing the shape of the cut or slit in the blank.

To enhance the appearance of the display tray the panel which is to form the rear side may be provided with suitable flaps, creases, or tear off perforated lines to provide a pop-up panel or display board to be positioned inside the display tray when erected. The panel of the blank from which the rear side is to be formed may be enlarged relative to the other panels for this purpose.

The blank and thereby the carton can be made in any suitable material which can be folded to form a carton and is not limited to any particular material, although corrugated cardboard is particularly suitable.

The blank is preferably folded to its overlapped state and secured mechanically. Conventionally such folding takes place by fold guides which operate in a direction perpendicular to the direction of travel of the blank to be folded through the machinery.

According to a ninth aspect of the present invention there is provided a process for the assembly of a blank according to the present invention into a state from which it can be erected into a carton, which process comprises the steps of:

conveying the blank in a direction in which one of the sections leads the other;

holding the leading section down; and pushing the other section in the direction of conveyance up over the leading section so that the blank is folded in one direction about one of the fold lines and in the other direction about the other so that the pushed section sits on top and overlaps the leading section.

As it is preferred for the upper part of the erected carton to be nested inside the lower part when the blank is inserted inner side up it is preferred that the leading section is the first section. To get the same result the blank could be fed in outer side up with the second section leading.

Folding in the direction of travel of the blank may be effected by any suitable mechanical means. Revolving fingers, paddles or dogs could be used to push the following section up onto the leading section. Space, e.g. cut outs, could be provided for such revolving members to pass through the blank.

The process may also include the step of securing the overlapping section. Securing of the overlapping section can be effected by applying adhesive to the appropriate parts of the overlapping regions. Adhesive may be applied from above or below the blank as it passes through the folding machinery depending on the parts to be secured. Application from below can be effected using a wheel of glue pads.

BRIEF DESCRIPTION OF THE DRAWINGS

For a better understanding of the present invention and to show how the same may be put into effect reference will now be made, for the purposes of illustration only, to the accompanying drawings in which.

DETAILED DESCRIPTION OF THE PREFERRED EMBODIMENTS

Figure 1:
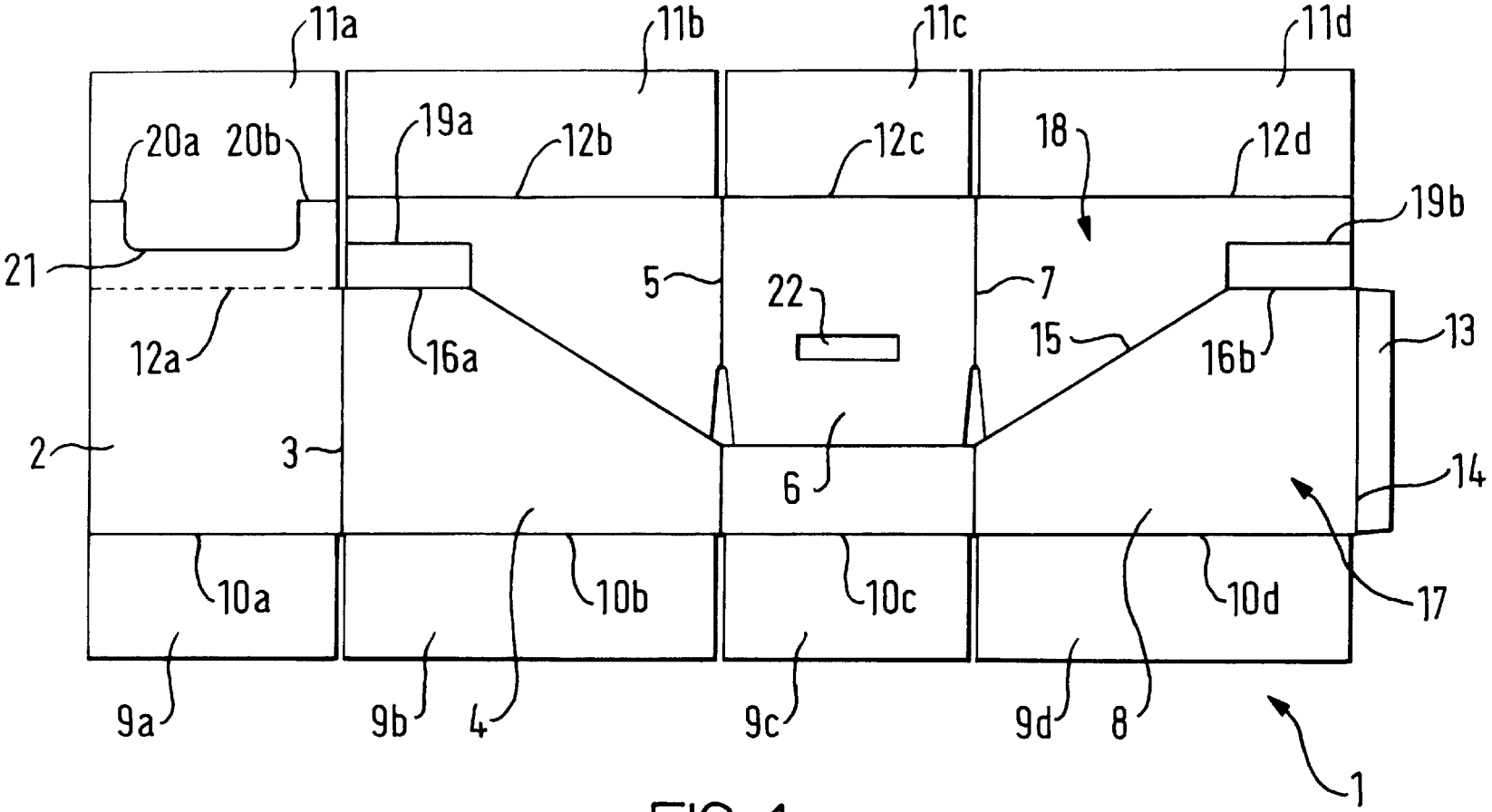
FIG. 1 is a plan view of the inner side of a first embodiment of a blank according to the present invention.
Figure 2:
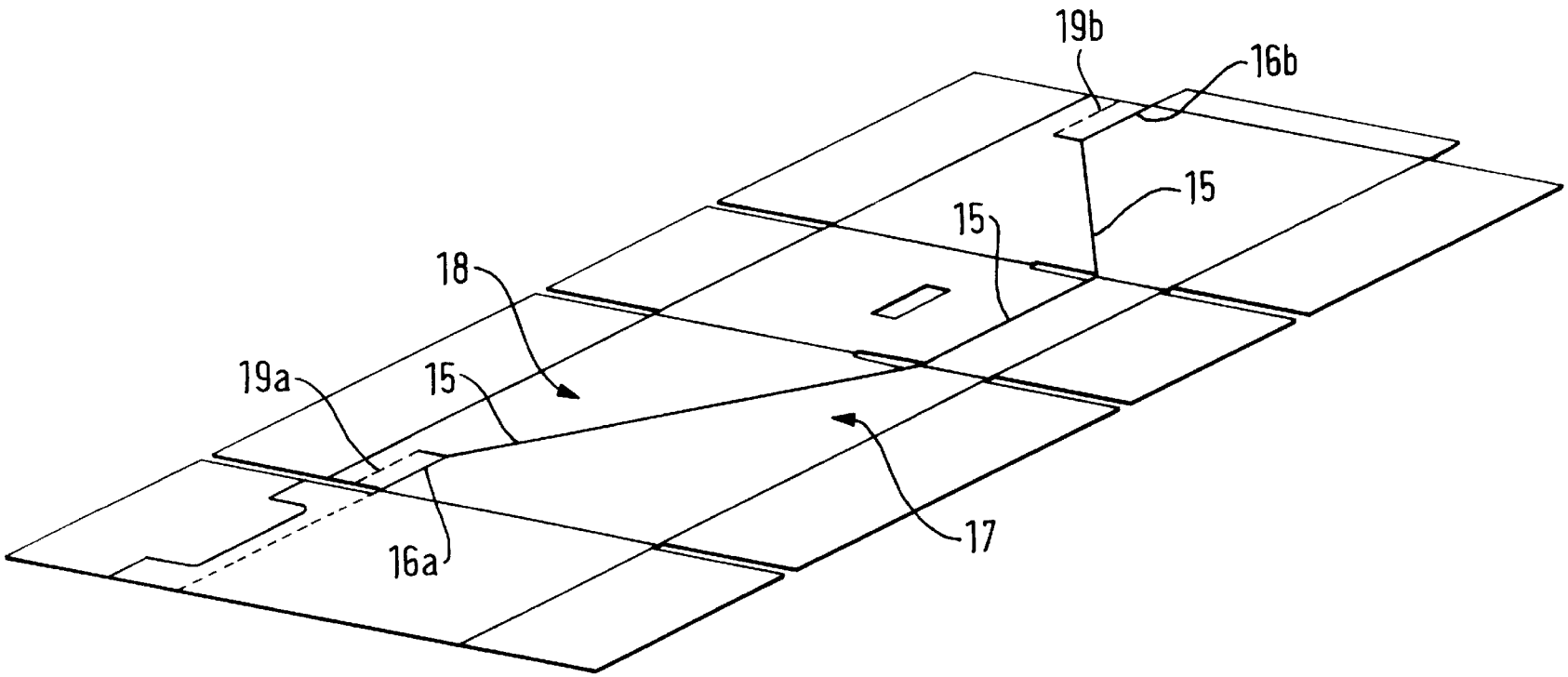
FIG. 2 is a perspective view of that blank.

The blank 1 of FIGS. 1 to 10 is substantially rectangular in shape and is erectable into a substantially cuboid carton which can be converted to a display tray. The blank 1 has a back panel 2 attached via a fold line 3 down one side to a side panel 4 which is attached down its other side via fold line 5 to a front panel 6 which is attached down its other side via a fold line 7 to a second side panel 8. The blank also has four bottom flaps 9*a–d* one of each of which is attached via a fold line 10*a–d* to one end of the back 2, front 6, and each side 4 and 8 panel as well as four top flaps 11*a–d* one of each of which is attached via a fold line 12*a–d* to the other end of the back 2, front 6, and each side 4 and 8 panel. The blank also has a side flap 13 (a glue lap) extending from the free side of the second side panel 8 to which it is attached via a fold line 14.

The blank has a machine-cut slit 15 which runs from towards the top of the first side panel 4 diagonally across that panel down to the fold line 5, straight across the front panel 6 substantially parallel with the top and bottom fold lines 9*c*, 12*c* from fold line 5 to fold line 7 and from there diagonally up towards the top of the second side panel 8. The slit 15 does not run diagonally across the whole of side panels 4, 8, but in both cases starts at a point positioned in from the bordering fold lines 3 and 14 respectively at the end of a fold line 16*a, b* provided on each of the side panels 4, 8 which runs substantially parallel with the top flap fold line 12*a, d*. The fold lines 16*a, b* extend from the edge of the slit 15 to the edge of the first and second panels 4, 8, i.e. to fold lines 3 and 14 respectively. The slit 15 divides the blank 6, and each of the first side panel 4, second side panel 8, and front panel 6 into a first section 17 and second section 18. In this embodiment the lower edge of the first section 17 corresponds in shape to the upper edge of the second section 18. Two lines of perforations 19*a, b* are provided on the second section 18 of the blank which are each of substantially the same length and substantially parallel to the side panel fold line 16*a, b*. The blank may be folded about the lines of perforations 19*a, b*. The area between the lines 19*a, b* and fold lines 16*a, b* defines the connection tabs.

The fold line 12*a* of the top flap 11*a* attached to the back panel 2 is positioned in line with fold line 16*a* on the first side panel 4, i.e. at substantially the same height up its panel as that other fold line. The back top flap 11*a* is provided with a further fold line substantially parallel to the fold line 12*b* which further fold line is in two parts 20*a, b* and which extends from the edges of the top flap 11*a*. The two parts 20*a, b* are joined together by a slit 21 which is substantially U-shaped, the ends of each of the limbs of which U join up with one of the parts 20*a, b* of the top flap further fold line.

The second section 18 of the blank is provided on the front panel 6 with a rectangular cut-out 22.

Figure 3:
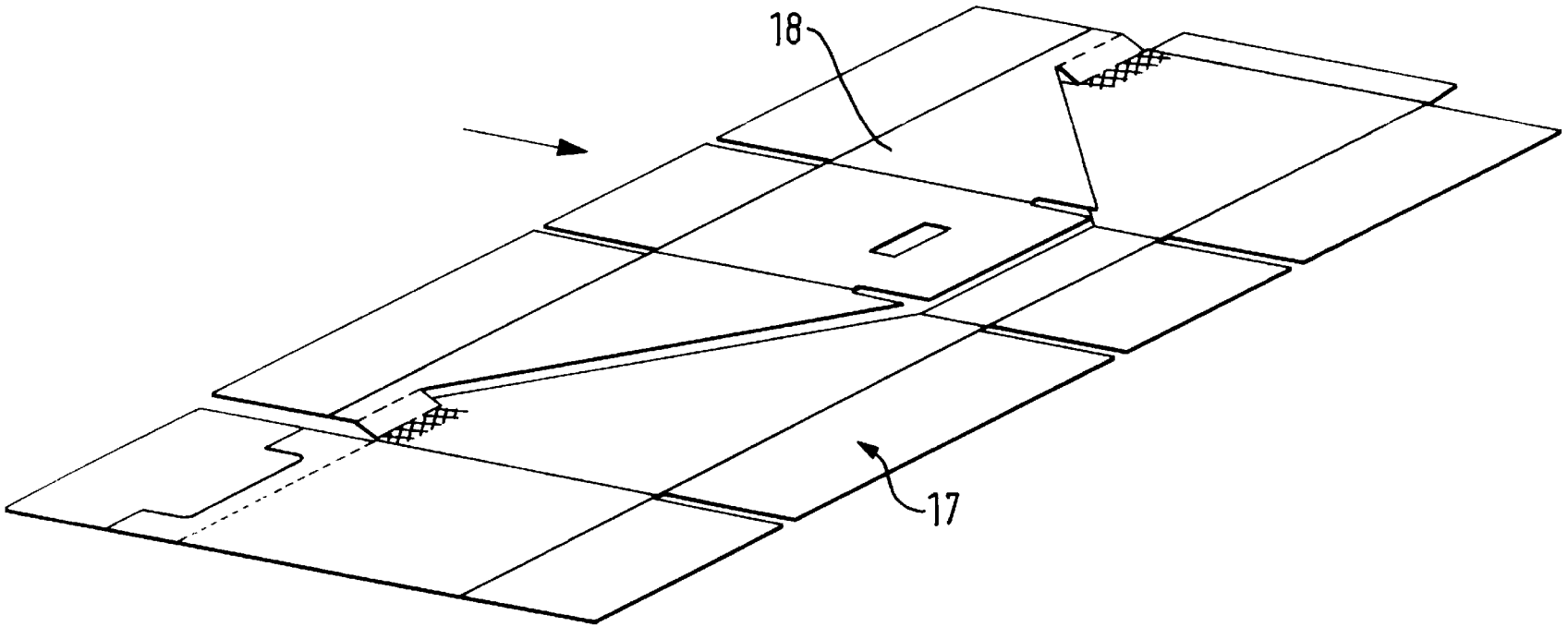
FIG. 3 shows that blank in a first stage of a machine folding process.
Figure 4:
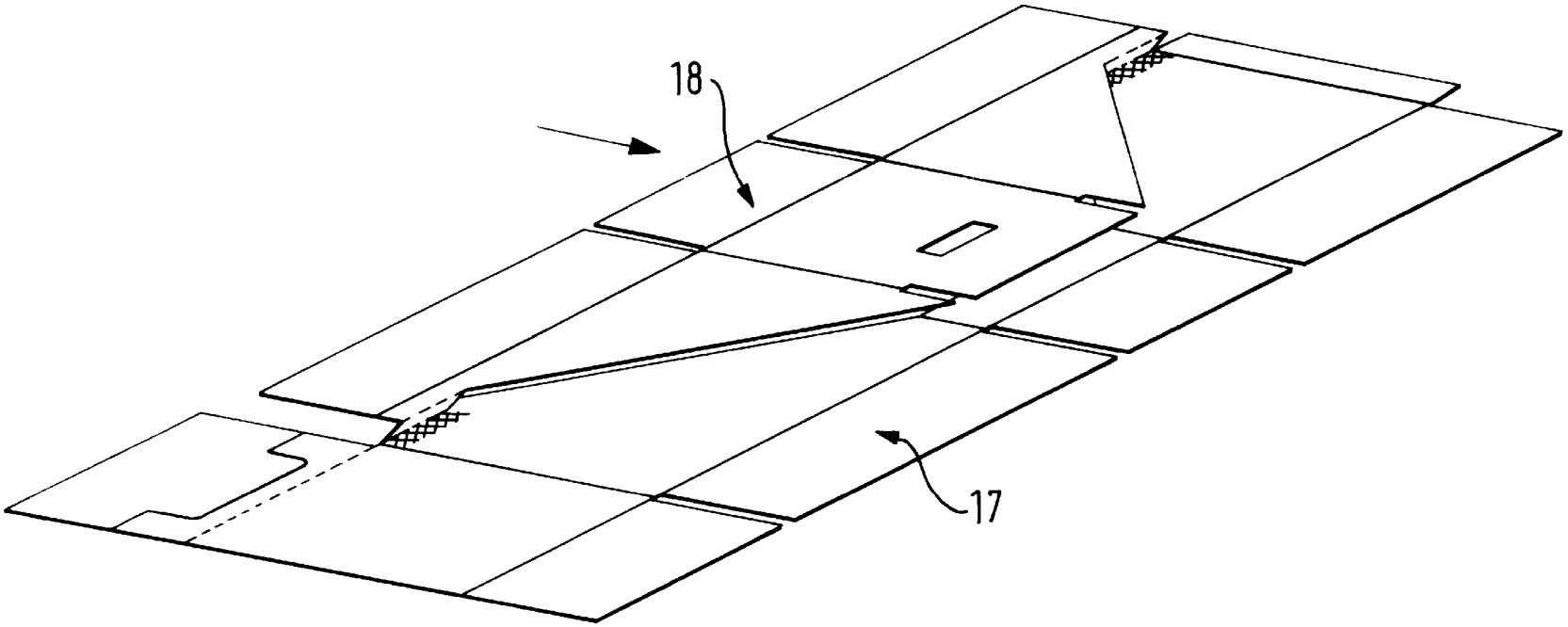
FIG. 4 shows the blank in a second stage of the folding process.
Figure 5:
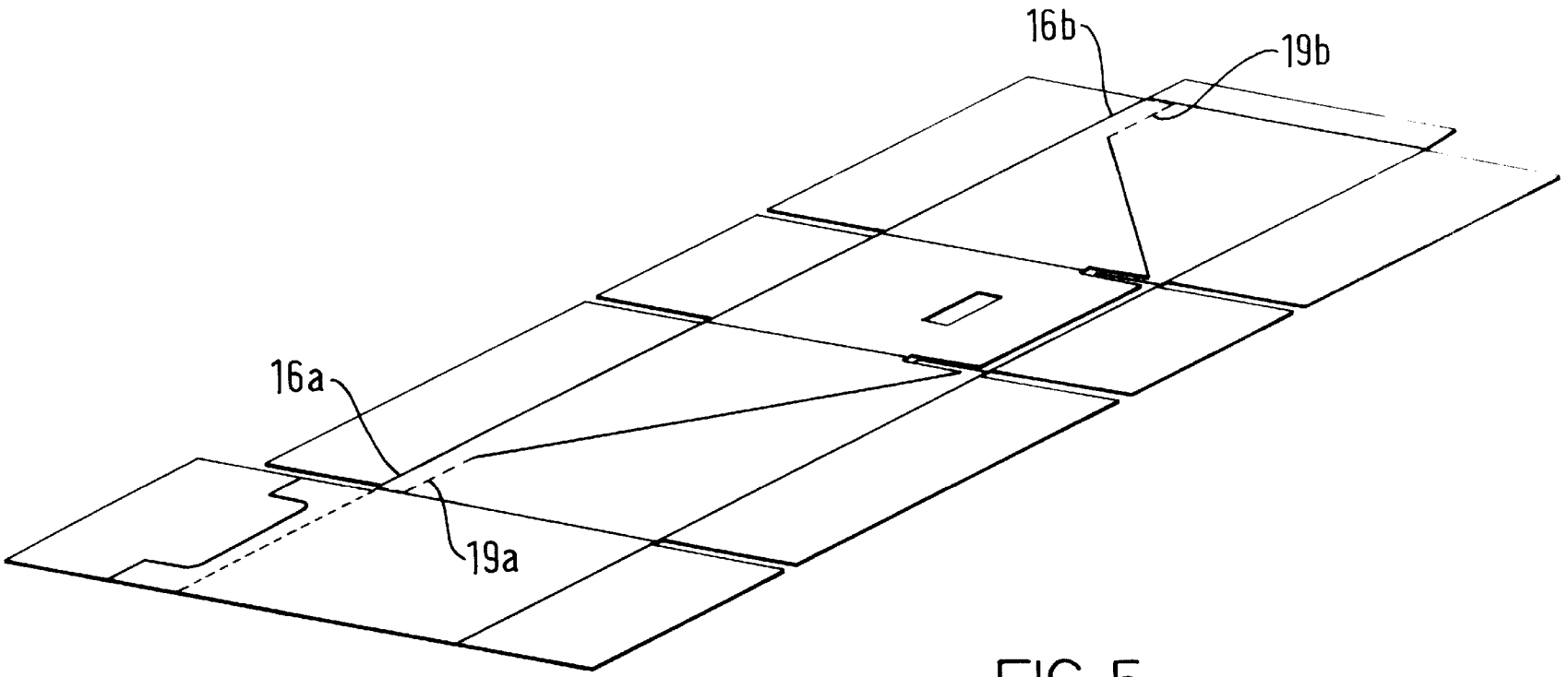
FIG. 5 shows the blank upon completion of the folding stage.

The blank is folded into a state in which it can be easily and quickly erected into a carton for transit as follows. The second section 18 is folded up over onto the first section 17 by folding in a first direction about fold lines 16*a, b* and in a second direction about the line of perforations 19*a, b* as shown sequentially in FIGS. 3, 4 and 5. After the folding the second section 18 overlaps the first section 17. In this embodiment only the front panel 6 of the second section 18 extends to the lower edge of its corresponding panel on the first section 16. It is only for that panel that the area of overlap corresponds in size to the height of the panel on the first section. The height of the overlap for the other panels is equal to the width of the connection tab. There is no overlap for back panel 2. The region of overlap with the connection tabs, i.e. the overlap between the fold lines 16*a, b* and the lines of perforations 19*a, b,* which is shown cross hatched in FIGS. 3 and 4, is provided with adhesive to stick the first 17 and second 18 sections together as shown in FIG. 5. This folding step can be carried out mechanically by a process in which the blank is fed sideways, i.e. with rear panel 2 leading into appropriate machinery and conventional fold guides located at the sides of the machinery fold the second section onto the first section by pushing it sideways, i.e. perpendicular to the direction of travel through the machinery. Alternatively and preferably the blank is fed into the machinery inner side up with the first section leading, i.e. in the direction shown by the arrow in FIG. 3. At least one guide, or more preferably several guides spaced at regular intervals, is then used to hold down the first section 17, e.g. via the bottom flaps 9*a–d* whilst mechanical means are used to push the second section 18 in the direction of travel up over the first section 17 so as to fold the second section 18 onto the first section 17. Adhesive to secure the overlapping areas may either be applied from above onto the inner side of the blank or from below (e.g. via gluing pads on a wheel situated below the blank). In FIG. 3 adhesive has been applied from above to the cross-hatched regions of the first section 17. This will result in the first section 17 being secured to the connection tab. Adhesive applied from below to the outer face of the blank on the region of the second section adjacent to the connection tab would lead to the second section being secured to the connection tab. If fold lines 16*a, b* are also lines of weakness the connection tab will then be removed with the upper part of the carton. Mechanical means for causing the simultaneous folding about the fold line 16*a, b* and the lines of perforations 19*a, b*, could take the form of a mechanical finger or fingers or some type of cam surface or revolving paddles or dogs and if necessary space (e.g. a cut out) could be provided in the blank to allow room for any such mechanical parts to pass.

As it is preferred that the overlapping region be positioned inside the erected carton it is preferred that the folding of the blank is such that the second section 18 lies on top of the side of the first section 17 which is to form the inside of the carton. This can be accomplished by first folding two inside sides of the blank together followed by the folding of two outside sides of the blank together. Such folding provides in effect a double overlapping of the first and second sections.

Figure 6:
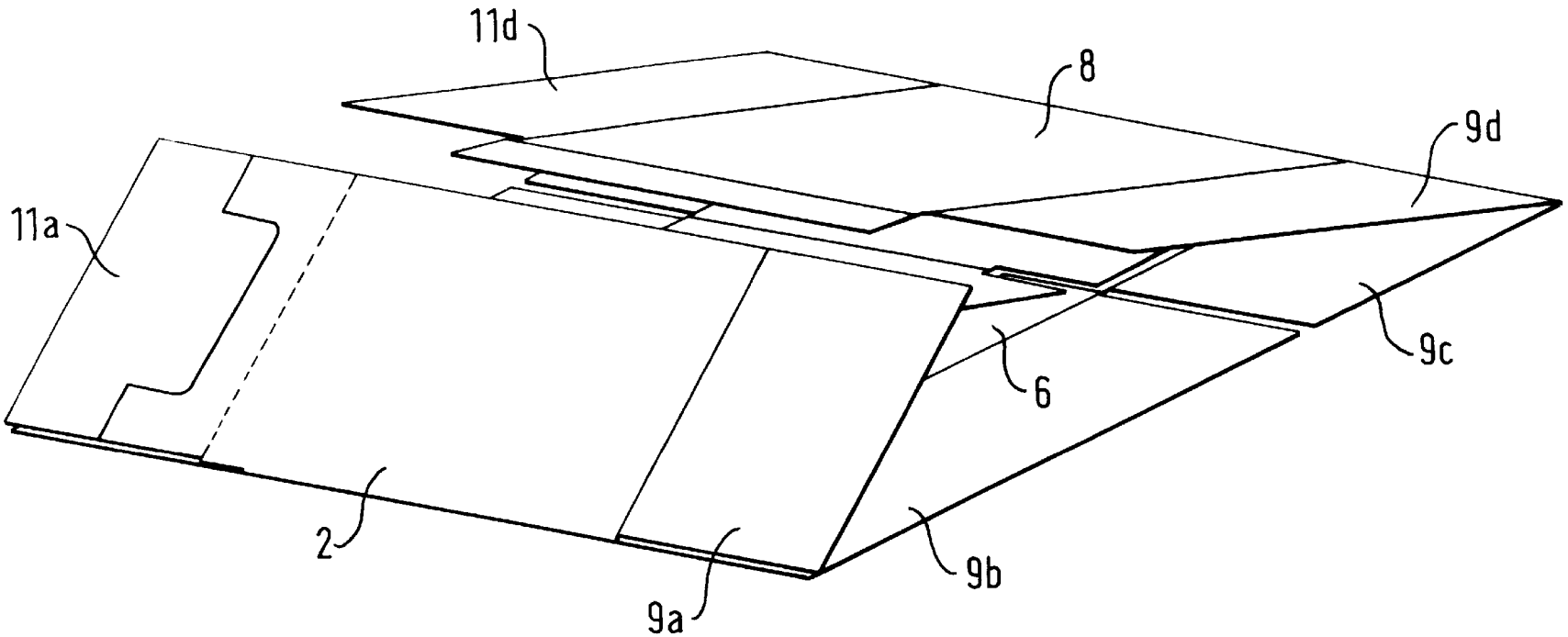
FIG. 6 shows the blank in a second folding stage.

To complete the erection of the blank 1 into a carton, as shown in FIG. 6 the blank 1 is folded along fold lines 3 and 7 such that the back panel 2 is folded onto the first side panel 4 and the second side panel 8 is folded on top of the front panel 6. The side flap (glue lap) 13 is provided with adhesive to stick it down onto the back panel 2. Again it is preferred that the side flap 13 be adhered to the inside side of the back panel 2 so that it is not visible from the exterior of the erected carton.

Figure 7:
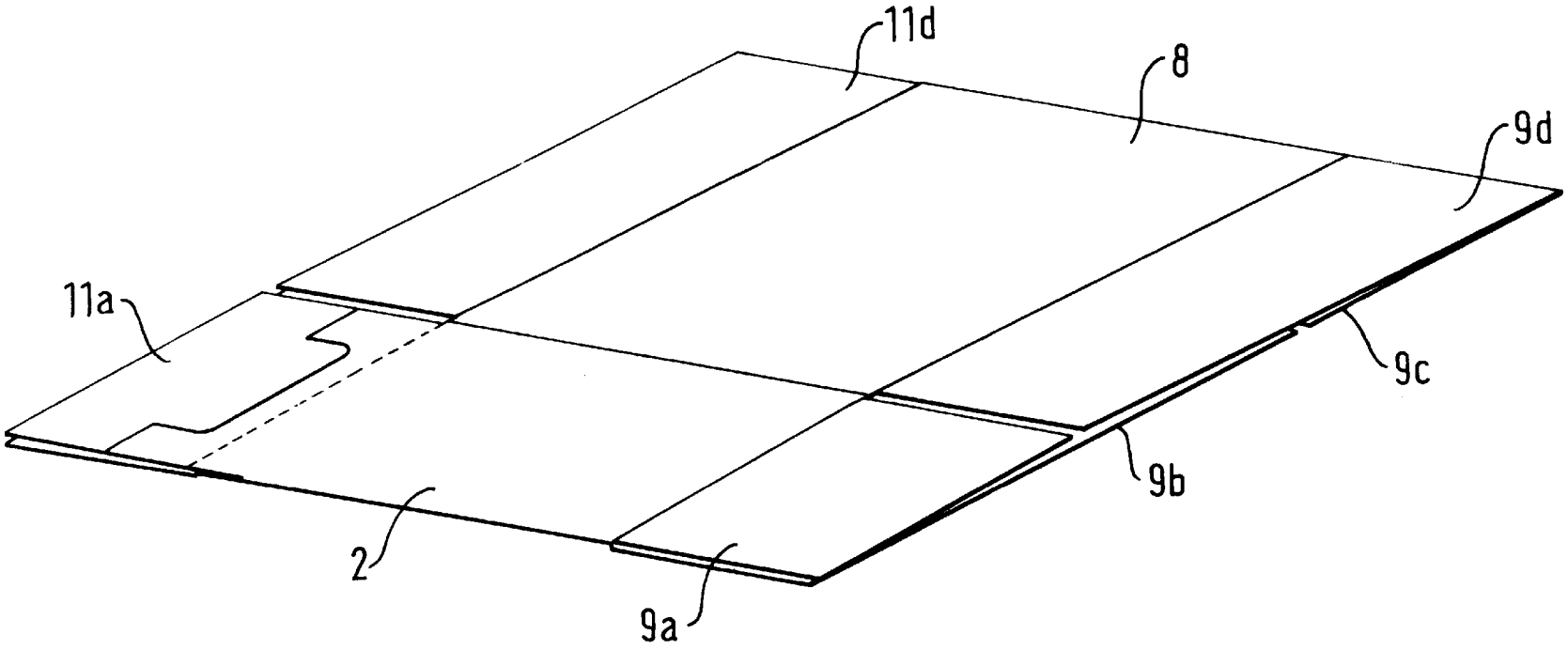
FIG. 7 shows the blank in the finished folded state.
Figure 8:
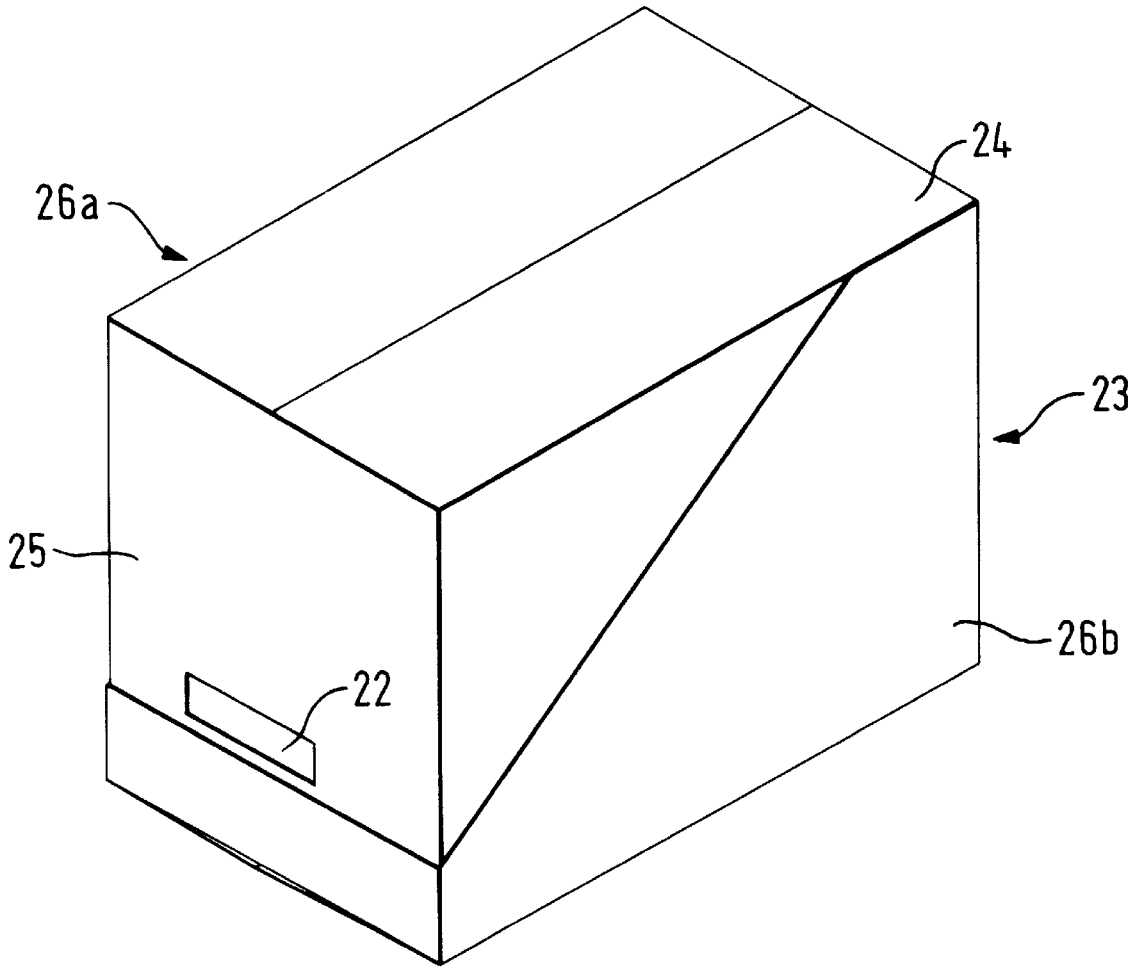
FIG. 8 shows a carton erected from the blank shown in FIGS. 1–7.

The blank 1 after these folding steps and adhesive steps is as shown in FIG. 7. It can be supplied to end customers in this state from which it is easy to fold the blank 1 along the remaining prepared fold lines to form an erected carton as shown in FIG. 8.

Figure 9:
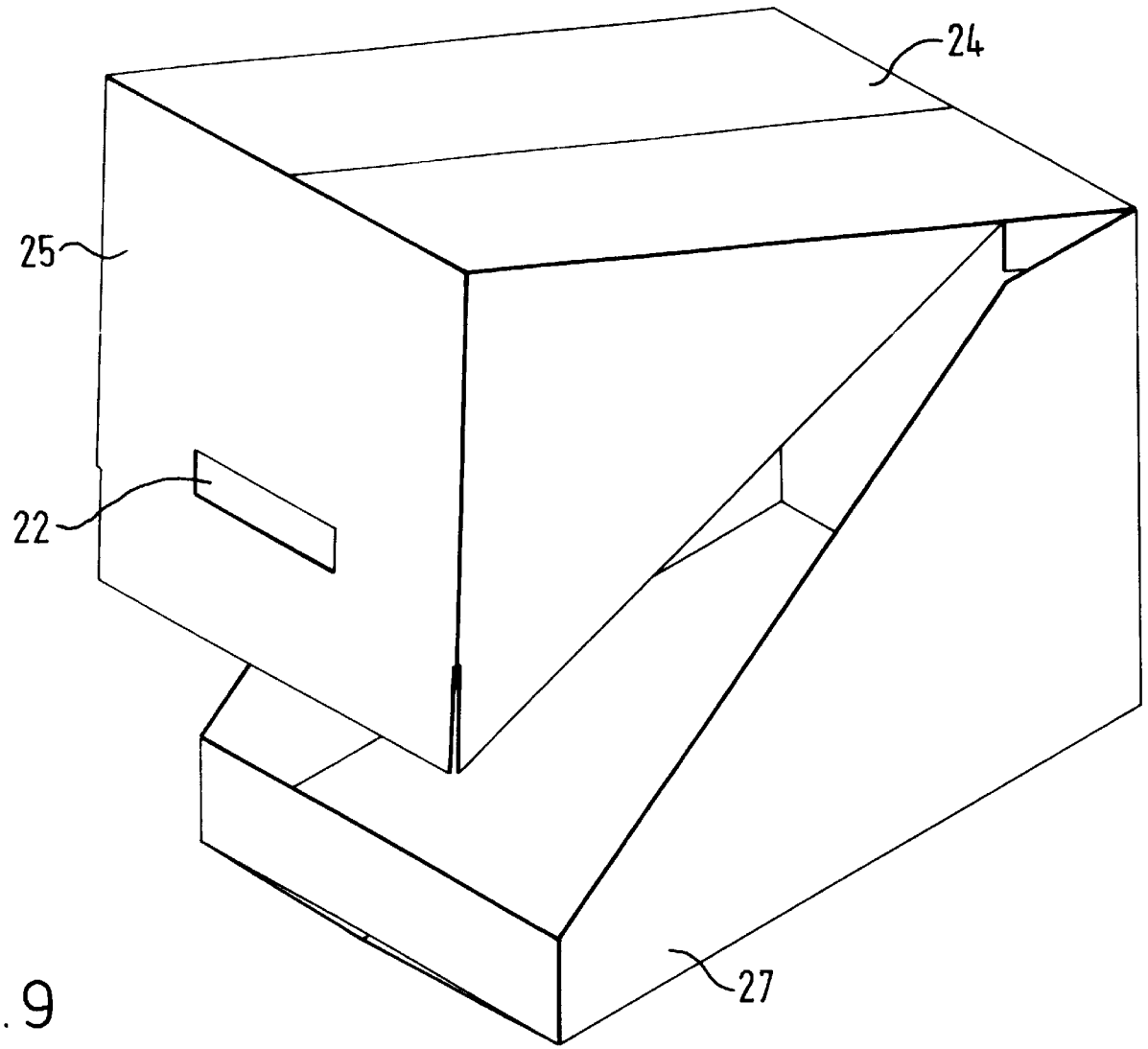
FIG. 9 shows the carton shown in FIG. 8 in the process of being converted to a display case.
Figure 10:
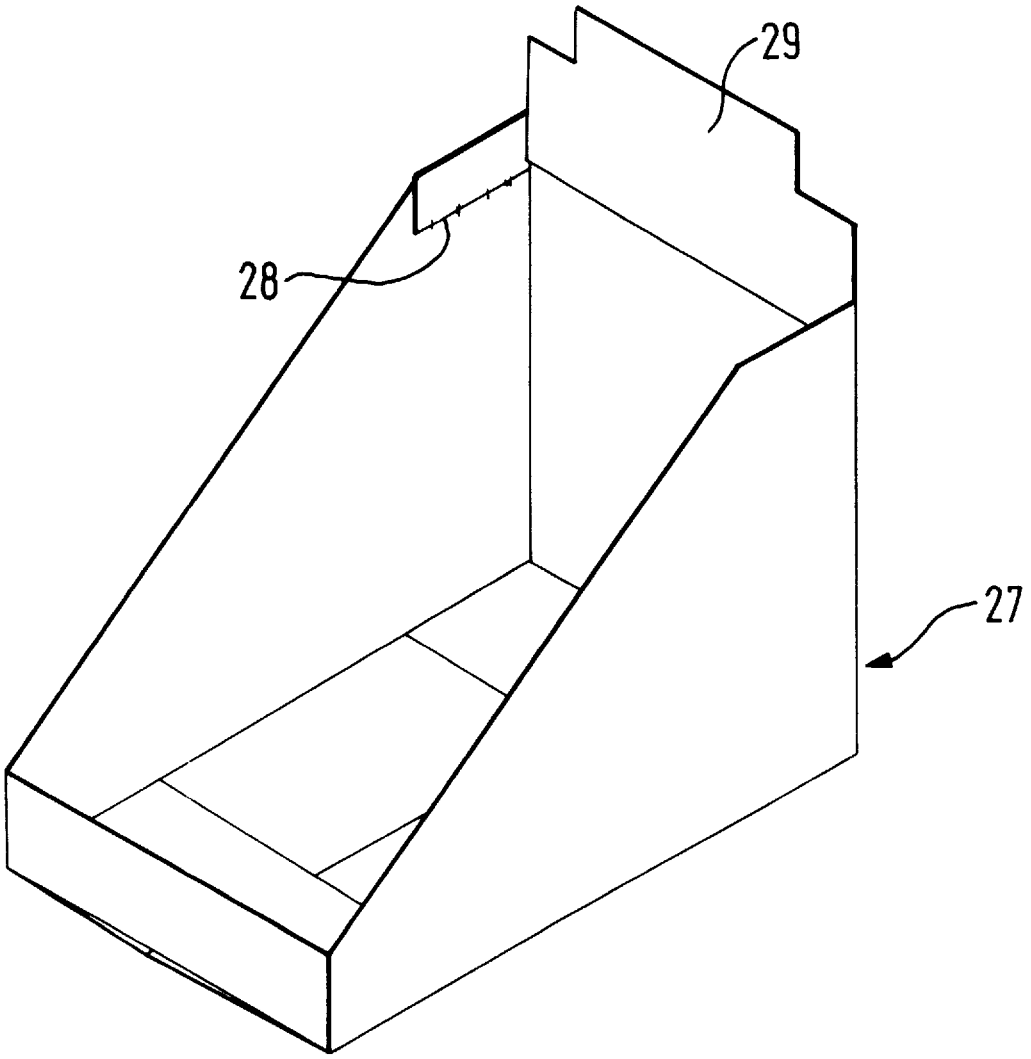
FIG. 10 shows the converted carton in the form of a display case.

The erected carton 23 is substantially identical to a conventional transit pack and can be used for the transportation of goods. It is also convertible into a display tray as is shown in FIG. 9. The operator merely has to remove the second section 18 of the blank 1, which forms the top 24 and part of the front 25 and sides 26*a, b* of the erected carton 23 by inserting a hand into the rectangular cut-out 22 in the front 24 of the carton. Jerking upwards causes the line of perforations 19*a, b* to break separating the first 17 and second 18 sections leaving the display tray 27 as shown in FIG. 10. The line of broken perforations 28 is inside the display tray 27 and does not adversely affect the visual appearance of the finished display tray 27. The back top flap 11*a* can be folded about fold lines 20*a, b* to provide a pop-up display panel 29.

Several modifications of the embodiment shown in the drawings are of course possible. As an example, the fold lines 16*a, b* and line of perforations 19*a, b* do not have to be provided on the side panels but on one or more of the other panels of the blank. Furthermore, the position of the slit and its shape can be varied to vary the height and shape of the front, side and back panels of the erected display tray. In the embodiment shown in the drawings the back panel is shown as a part of the first section of the blank but it could also be divided between the first and second section depending on the positioning of the slit. Furthermore the cut-out 22 to assist in the opening of the carton could take any suitable shape or size to facilitate opening and more than one such cut-out or type of cut-out could be possible. A preferred alternative would be to provide two suitable finger cut-outs close to the line of weakness 19*a, b*. The shape and positioning of the pop-up display panel can be varied by varying the position and shape of the fold lines 20*a, b* and slit 21. If desired, however, the fold line 11*a* between the back panel 2 and the top flap 11*a* can be provided with a line of perforations so that the top flap 11*a* can be removed altogether from the display case.

Figure 11:
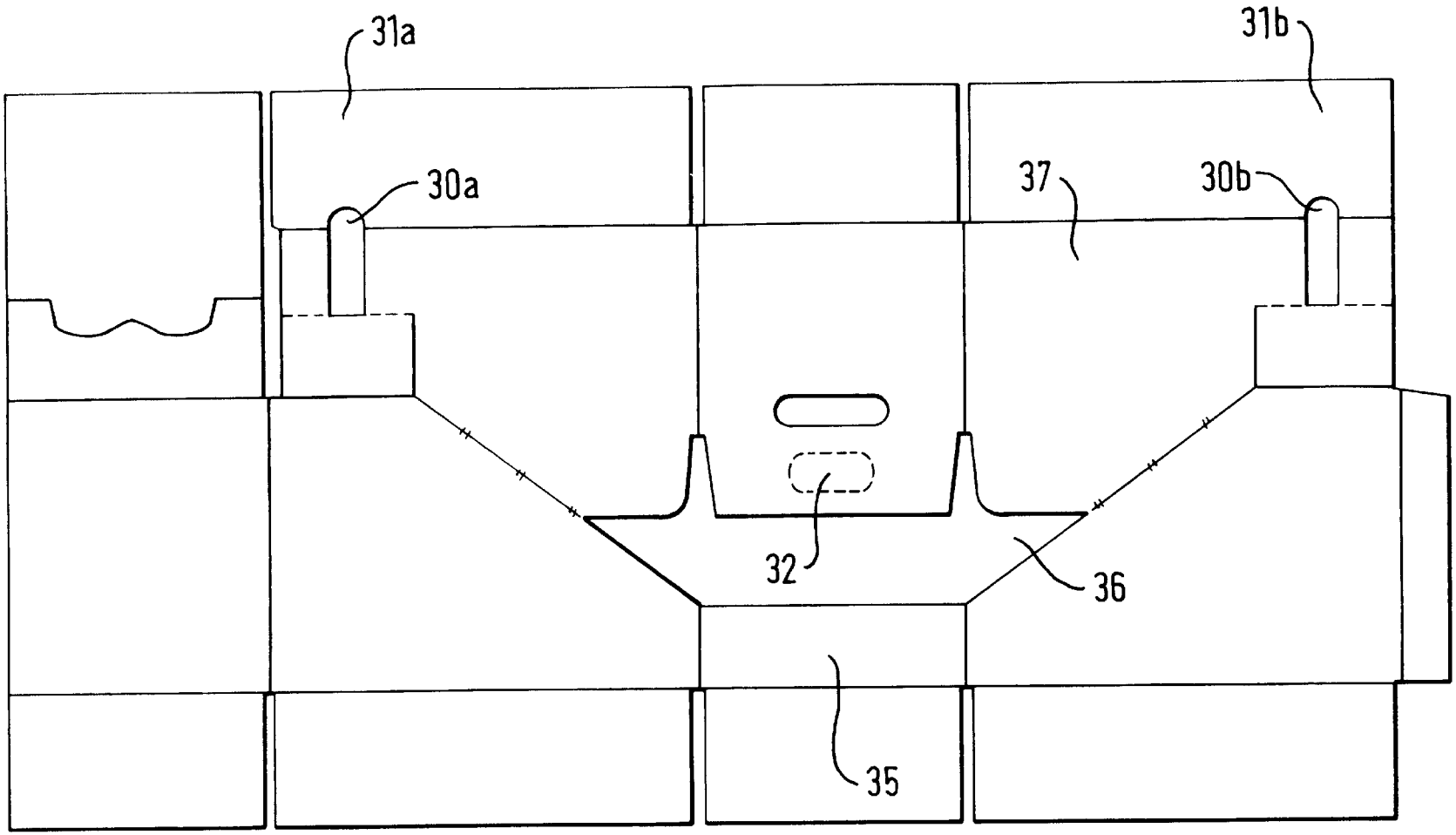
FIG. 11 shows a plan view of the inner side of a second embodiment of a blank according to the present invention.

In FIG. 11 of the drawings there is shown a second embodiment of a blank according to the present invention which is substantially as that previously described but is provided with cut-outs 30*a, b* which allow mechanical folding paddles to pass through. The cut-outs 30*a, b* extend onto the side top flaps (31*a, b*) to give finger holes to aid separation of the lower and upper parts of a carton erected from the blank.

The blank is also provided with an additional pop-out area 32 located on the front panel 33 below the rectangular cut-out hand hold 34. The area of overlap of the pop-out area 32 on the first section 35 of the blank can be secured by adhesive to give additional strength and stability to the erected carton. During separation the pop-out area 32 would separate itself from the upper part of the carton and would remain secured to the display tray. To make further savings of material a cut-away area 36 from the second section 37 is also provided.

The blank and carton of the present invention is advantageous as it is easy to erect and to convert from a transit pack to a display tray, provides a display tray with a clean upper edge, is easy to manufacture as does not require the alignment of two separate pieces of material (which leads to a decrease in the number of imperfect products produced), has good stacking strength, and is very economical on material of manufacture as a substantially rectangular blank which makes good use of material and provides little waste can be used. The blank and carton is more specifically advantageous for the following further reasons. The amount of material used can be kept to a minimum as the inner (upper) part does not need to extend to the bottom of the carton. Also the area of overlap of the upper and lower parts can be kept to a minimum to minimize the material used. Securing of the upper and lower parts results in a strong transit pack which can easily withstand handling and transportation. The shape and height of the sides of the display tray can be simply varied without the need to increase the amount of material required for the blank and without the need for wasteful cut-outs in the blank. The blank is also easily manufactured and assembled for erection by machine.

What is claimed is:

1. A blank for erection into a carton, the blank comprising:

a first region;

a second region;

at least one connecting tab which connects the first region to the second region;

a line of weakening about which the connecting tab can be folded into direct contact with one of the first and second regions; and a hinge line about which the connecting tab can be folded into direct contact with the other of the first and second regions, the connecting tab being secured in such direct contact with the said other of the first and second regions, whereby the connecting tab is disposed between the first and second regions and the first and second regions partially overlap each other, the first region being separable from the remainder of the blank by tearing along the line of weakening.

2. The blank of claim 1, further comprising creases which define a plurality of side wall panels, said panels forming side walls of a carton erected from the blank, at least one of the side wall panels comprising a panel region of the first region and a panel region of the second region, which panel regions overlap each other.

3. The blank of claim 2, wherein at least one of the side wall panels is constituted wholly by a panel region of the second region.

4. The blank of claim 2, wherein three consecutive side wall panels each comprise a respective panel region of the first region and a respective panel region of the second region.

5. The blank of claim 4, wherein two of the said connecting tabs are provided, each connecting tab interconnecting the respective overlapping panel regions of the outermost two of the said three side wall panels.

6. The blank of claim 2, wherein each side wall panel is provided at opposite edges with closure flaps which are to form closures of a carton erected from the blank.

7. The blank of claim 6, wherein the closure flap at one edge of the said at least one side wall panel is part of the first region of the blank, and the closure flap at one opposite edge of the said one side panel is part of the second region of the blank.

8. The blank of claim 7, wherein each panel region making up the said at least one side panel terminates at its edge away from the respective closure flap at a free edge of the material of the blank, which free edge lies between the opposite edges of the other panel region of that side wall panel.

9. A blank for erection into a carton, the blank comprising:

four rectangular side wall panels, the panels being disposed in a row and connected to one another at side edges defined by creases in the blank;

upper and lower closure flaps, the closure flaps being connected respectively to side wall panels at upper and lower edges defined by creases in the blank;

wherein the lower closure flaps, an end one of the side wall panels, the upper closure flap of that end side panel and lower regions of the remaining side wall panels comprise a first region of the blank, and the remaining upper closure flaps and the upper regions of the remaining side wall panels comprise a second region of the blank, the blank further comprising connecting tabs disposed at opposite ends of the second region of the blank, each connecting tab being connected to the first region at a hinge line and being secured in face to face contact with the first region, and being connected to the second region at a line of weakening and lying in face to face contact with the second region, the first region and the second region being severed from each other between the connecting tabs to provide an upper free edge of the first region and a lower free edge of the second region, the first and second regions partially overlapping each other with the upper and lower free edges being disposed between the upper and lower edges of the respective side wall panels.

* * * * *